US006877179B2

(12) United States Patent
Marfione

(10) Patent No.: US 6,877,179 B2
(45) Date of Patent: Apr. 12, 2005

(54) BROADHEAD HANDLE AND SHARPENING APPARATUS

(76) Inventor: Anthony Marfione, 932 SE. 36th Ct., Vero Beach, FL (US) 32968

( * ) Notice: Subject to any disclaimer, the term of this patent is extended or adjusted under 35 U.S.C. 154(b) by 64 days.

(21) Appl. No.: 10/386,187

(22) Filed: Mar. 11, 2003

(65) Prior Publication Data

US 2003/0172463 A1 Sep. 18, 2003

Related U.S. Application Data

(60) Provisional application No. 60/363,208, filed on Mar. 12, 2002.

(51) Int. Cl.[7] ..... B26B 11/00
(52) U.S. Cl. ..... 7/158; 30/337
(58) Field of Search ..... 30/337; 7/158, 7/167

(56) References Cited

U.S. PATENT DOCUMENTS 4,570,941 A * 2/1986 Saunders ..... 30/337
4,643,435 A * 2/1987 Musacchia ..... 30/337
5,528,831 A * 6/1996 Fortenberry ..... 7/158
6,701,626 B2 * 3/2004 Knoop ..... 30/337

* cited by examiner

*Primary Examiner*—James G. Smith
(74) *Attorney, Agent, or Firm*—Kevin Redmond

(57) ABSTRACT

A handle to grip a broadhead arrow head enabling the handle and arrow head combination to form a knife suitable for hunting purposes. The handle includes a release button, a wrench, and a first and a second cavity. The first cavity accepts a shaft on the rear of the broadhead to aid in connecting the broadhead and handle. The release button activates a grip mechanism which locks the broadhead in the handle, while the wrench serves to aid in loosening or tightening the broadhead to the arrow shaft. The second cavity houses a sharpening guide which attaches to the handle and guides a sharpening rod at the correct angle to sharpen the broadhead.

11 Claims, 4 Drawing Sheets

BROADHEAD HANDLE AND SHARPENING APPARATUS

This application claims the benefit of prov. 60/363,208 filed on Mar. 12, 200.

BACKGROUND

1. Field

The present invention relates to broadhead archery arrows, herein referred to as simply broadheads, and more particularly to the multiple use of such arrow heads as well as a means for maintaining the sharpness of the arrow heads.

2. Prior Art

There are a number of prior art patents relating to archery arrows, knives with detachable blades, and means for sharpening such arrow heads and blades. The following patents are representatives of the prior art in these areas.

U.S. Pat. No. 4,428,515, illustrates a scabbard with angularly arranged abrasive elements to engage and sharpen a knife blade. As the blade and the abrasive element wear, there is nothing to correct the angle of the abrasive with respect to the blade in order to accurately re-sharpen the blade. In addition there is no provision for removal of the blade so that it can serve an additional function.

U.S. Pat. No. 5,303,469 illustrates a handle which grips a blade by means of a knob which is tightened against the blade to hold the blade in place. There is no provision to have the blade quickly locked in place, nor does this device have a sharpening guide to accurately set the sharpening angle.

U.S. Pat. No. 5,594,966 illustrates a knife with a blade sharpener stored in the handle. However, it fails to have a sharpening guide or a quick blade release mechanism.

U.S. Pat. No. 5,720,105 illustrates a blade handle which permits the blade to extend out of the handle. However, it fails to have a blade that can be conveniently detached for alternate use away from the handle.

The present invention, which is described below, overcomes all the shortcomings noted above for the referenced prior art patents by providing a handle that permits quickly locking a broadhead into the handle, while at the same time, providing a sharpening guide in a jig arrangement with the handle to accurately sharpen the broadhead. It is a useful combination in that both sharpening the broadhead blade and providing a sharp knife are both quite advantageous while engaged in hunting activities.

SUMMARY

It is an object of the present invention to provide a handle which holds a broadhead arrow head to form a hunting knife.

It is an object of the present invention to provide a handle for a broadhead which permits the broadhead to be secured to the handle by a gripping mechanism that requires no tools for activation.

It is an object of the present invention to provide a handle which can be used to quickly grip and quickly release a broadhead.

It is an object of the present invention to provide a sharpening guide for the broadhead which is stored within the handle and is quickly attached to the handle in its operating position.

It is an object of the present invention to provide a sharpening guide which attaches to a handle, to use the handle and guide as a jig for correctly sharpening the broadhead.

It is an object of the present invention to provide a wrench that may be used to tightening or loosening a broadhead on an arrow shaft.

It is an object of the present invention to provide a handle for a broadhead which includes as an integral part of the handle a wrench for tightening or loosening a broadhead on an arrow shaft.

The present invention includes a handle to grip a broadhead arrow head enabling the handle and arrow head combination to form a knife suitable for hunting purposes. The handle includes a release button, a wrench, and a first and second cavity. The first cavity accepts a shaft on the broadhead to aid in connecting the broadhead to the handle. The release button activates a grip mechanism which locks the broadhead in the handle, while the wrench serves to aid in loosening or tightening the broadhead to the arrow shaft. The second cavity houses a sharpening guide which may be attached to the handle to guide a sharpening rod at the correct angle to sharpen the broadhead arrow head.

To use the invention, a shaft extending from the rear of the broadhead is easily inserted into the first cavity where it is seated and locked in position by merely pressing and releasing the release button. With the broadhead locked into the handle, the combination of the broadhead and handle can be used as a knife or the broadhead can be correctly sharpened using the handle as a jig in combination with a sharpening guide. To sharpen the broadhead, the sharpening guide is pressed into place on the handle and a sharpening rod is placed through a hole within the guide with its abrasive surface positioned across the broadhead's blade edge. The guide automatically places the sharpening rod at the correct angle with respect to the broadhead for sharpening the broadheads blade edges. The rod is then simply moved back and forth across the blade's edge to effect the correct sharpening of the broadhead.

DETAILED DESCRIPTION OF THE INVENTION

Figure 1:
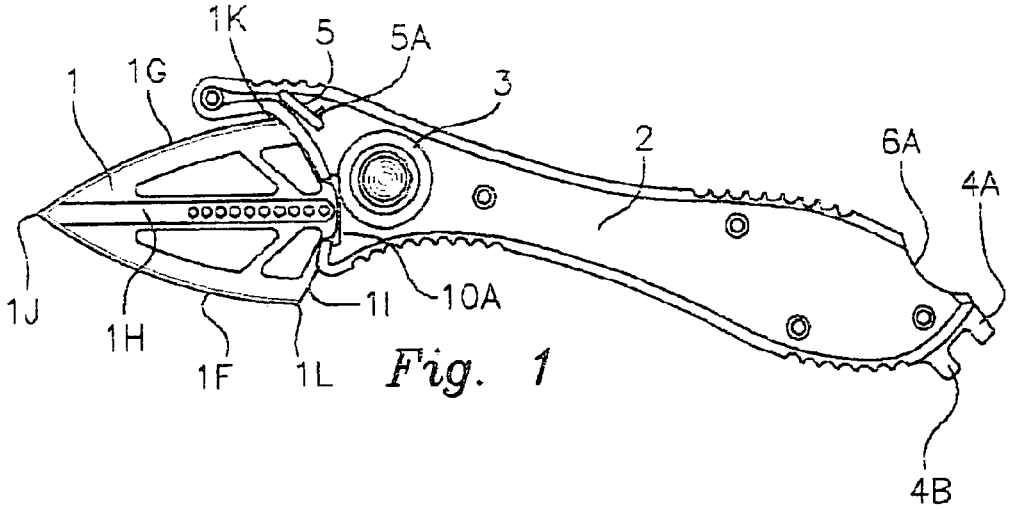
FIG. 1 is a side view of a broadhead held by a handle.
Figure 2:
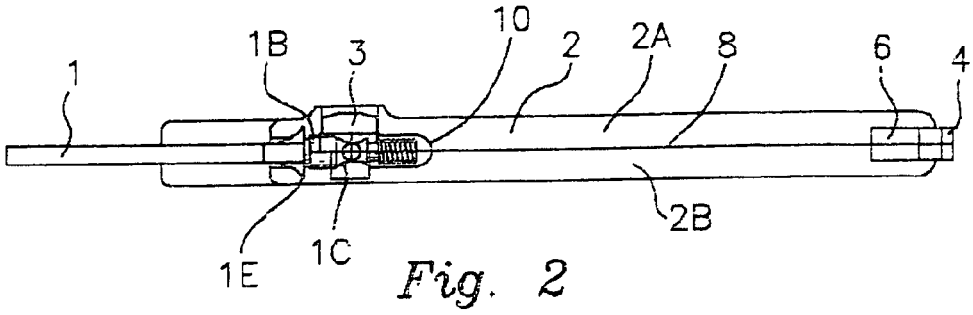
FIG. 2 is a cross sectional top view of the broadhead and handle with a release button which controls the grip mechanism used to secure the broadhead to the handle. The release button is in the release position in this Figure.

FIG. 1 is a side view of a broadhead 1 held by a handle 2, while FIG. 2 is a cross sectional top view of the handle and blade shown in FIG. 1. The handle, as shown in FIG. 1, has a central longitudinal axis running generally horizontally through it and it has two sides or halves 2A and 2B, the first of which 2B is shown in FIG. 1. For purposes of description herein, a horizontal plane is a plane drawn horizontally across a figure and a vertical plane is a plane that is perpendicular to a horizontal plane. The sides of the handle lie generally in parallel vertical planes while the top and bottom lie generally in parallel horizontal planes. The second side 2A is located directly opposite the first side. Both sides are generally parallel to one another and both are parallel to the central longitudinal axis. The handle includes a front or first end to the left and a second or back end to the right. It can be seen in this Figure that the broadhead 1 includes a first sharpened blade edge 1F and a second sharpened blade edge 1G and the broadhead is connected to the first end of the handle. The first end of the handle has a first cavity 10 shown in FIG. 2 with an opening 10A. The opening 10A is primarily in the form of a slot with a central axis that is positioned generally vertically and is designed to accept the broadhead. The broadhead is pushed into the slot and held within the first cavity to form a knife from the broadhead and the handle.

The handle includes a second slot 5 for a sharpening guide 9, a detent pin 5A to hold the guide in the slot, a release button 3 to release the broadhead, an opening 6A to a second cavity 6 within the handle for storing the guide 9 and a wrench 4 consisting of a first tooth 4A and a second tooth 4B, both teeth extending outwardly from the second end of the handle. The cavity 6 can be seen in FIG. 2. The wrench is used to connect and disconnect the broadhead from an arrow shaft.

The second slot 5 for the sharpening guide is located on the upper portion of the handle's first or front end. The second slot forms an angle of typically 45° with respect to the central longitudinal axis of the handle but can range from 30 to 60 degrees to cause the sharpening guide to face the lower cutting edge of the arrow head so that a sharpening rod can be used to correctly address this edge during the sharpening operation. The release button is located in the middle of the handle, just to the right of the broadhead. The opening 6A to a first cavity 6 is located in the upper portion of the second end of the handle. The wrench is located just below the opening 6A on the second end of the handle.

Figure 3:
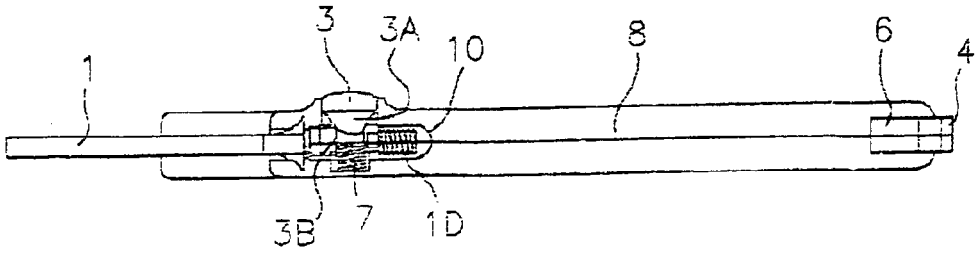
FIG. 3 is a cross sectional top view of the broadhead and handle with the release button in the locked position.
Figure 4:
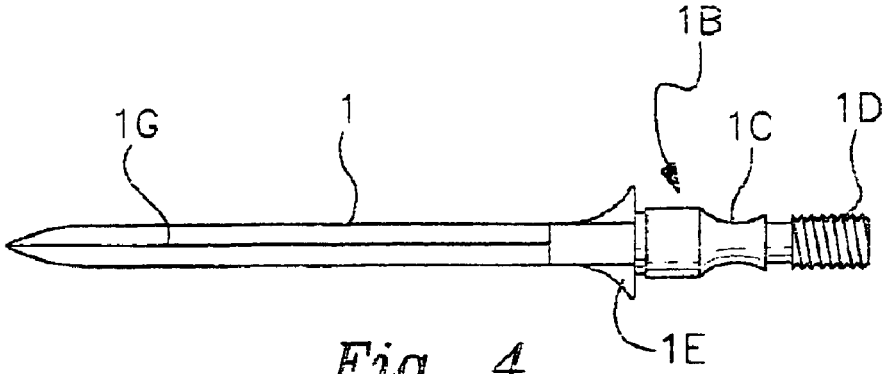
FIG. 4 is a top view of the broadhead showing a necked-in portion used in conjunction with the release button to secure the broadhead to the handle.

FIG. 3 is a cross sectional top view of the broadhead arrow head and the knife handle while FIG. 4 is a top view of the broadhead arrow head 1 showing it to include a broadhead shaft 1B which extends to the tight of an unsharpened arrow head edge 1I that is shown in FIG. 1. The broadhead arrow head is generally flat and approximate a triangle with three tips such as tips 1J and 1K with 1J being the arrow point. The arrow head has two cutting edges 1F and 1G which meet in the point 1J. A central longitudinal axis runs through a central arm 1H of the arrow head and lies between cutting edges 1F and 1G. The central longitudinal axis of the arrow head extends from the arrow point 1J through the central arm 1H and all the way through the arrow head shaft 1B. It can be seen in FIGS. 1, 2 and 3 that the arrow head shaft 1B is connected to the arrow head along the unsharpened cutting edge of the arrow 1I. The shaft portion of the broadhead include a flange 1E, a neck 1C, and a threaded end 1D which is located at the right end of the broadhead shaft and is used to attach the broadhead to an arrow shaft. The arrow shaft typically includes a threaded socket designed to accept the threaded end 1D of the broadhead.

The release button 3 is shown in FIG. 2 in its blade release or downward position. Downward refers to the button being pressed downward into the knife handle. The release button is typically a short cylinder having a first and a second end. The first end of the cylinder faces outward and is referred to as the contact surface which is pressed to activate the button. A rod is either attached to or in contact with the second end of the button. The release button is shown in its blade grip or upward position in FIG. 3. This button includes on its rod a tapered down portion 3A located immediate below the second end of the button. Below the tapered down portion 3A is the remainder of the shaft portion 3B which extends across the handle over the neck of the broadhead and into a first spring 7 which biases the button in an upward direction. In the upper part of the button shaft 3B is a relieved area to allow the broadhead shaft 1B to pass by the button. When the broadhead has fully entered into the first cavity and is seated, releasing the button results in the button rising along with the portion of the button shaft 3B that has not been relieved. This unrelieved portion passes through the neck of portion 1C of the broadhead shaft 1B and rests on this portion of the broadhead shaft. This position of the release button locks the broadhead in the handle. The button must be depressed and held in the depressed position to release the broadhead from the handle.

Figure 5:
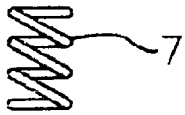
FIG. 5 is a side view of the spring used in the release button grip mechanism to bias the button outwardly of the handle.
Figure 6:
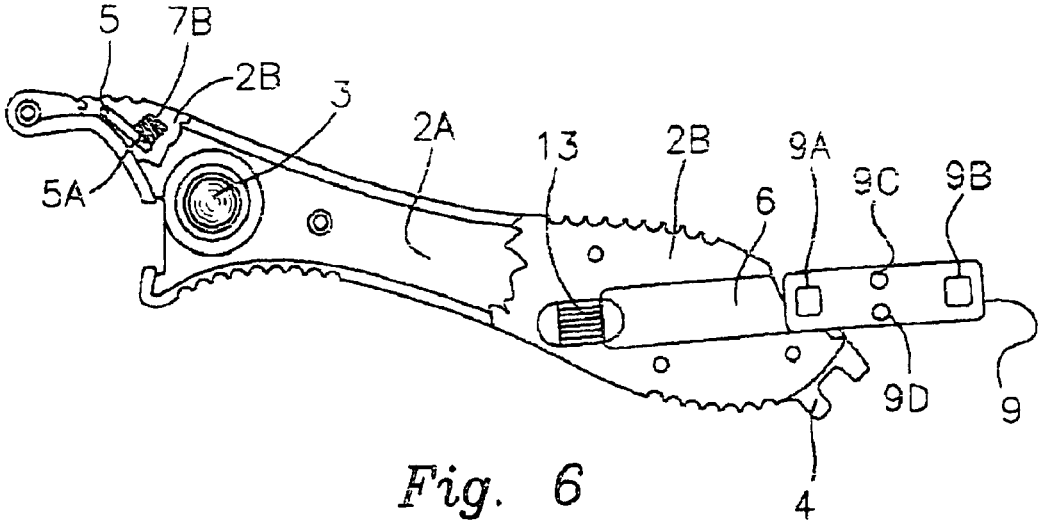
FIG. 6 is a side view of the broadhead and handle with a partial cross sectional view of the handle used to show the cavity for storing the sharpening guide. The guide, in this Figure is shown immediately adjacent to its storage cavity.

FIG. 5 is a side view of spring 7 used in the operation of the release button. FIG. 6 is a partial cross sectional view of the handle 2 which is divided into two halves 2A and 2B. These halves were first shown in FIGS. 2 and 3. In FIG. 2 half 2A is the upper half, while 2B is the lower half. The cavity 6 is for storing the sharpening guide 9 which can be seen in FIG. 6 along with the magnet 13 used to hold the guide in the cavity.

Figure 7:
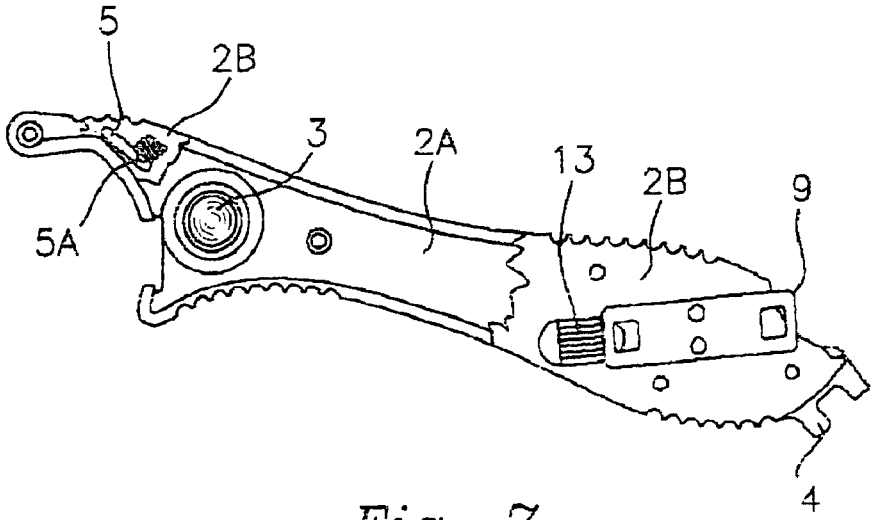
FIG. 7 is a side view of the broadhead and handle with a partial cross sectional view of portions of the handle showing the guide's position when stored within the handle.

FIG. 7 is a partial cross sectional view similar to FIG. 6 showing the guide 9 when stored in the cavity 6.

Figure 9:
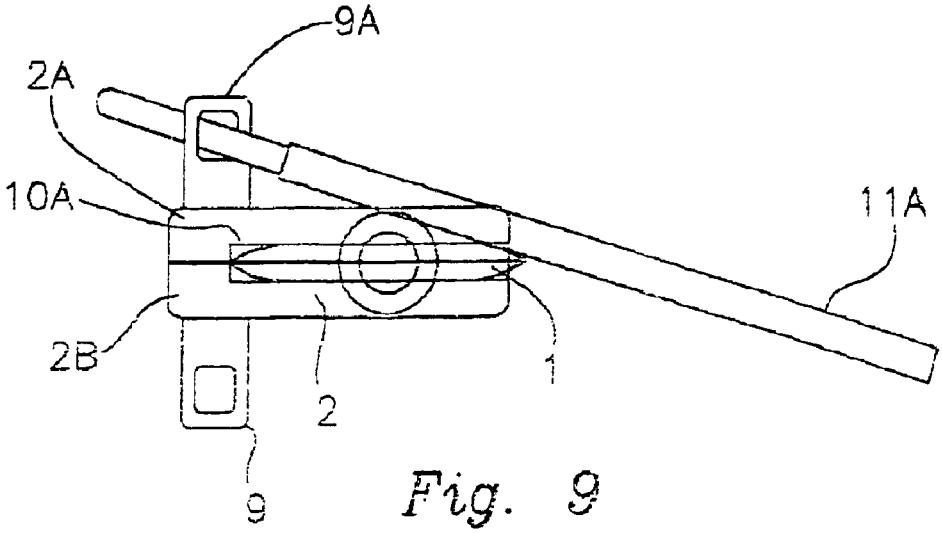
FIG. 9 is a forward end view of the handle with the guide attached as in FIG. 8 and the sharpening rod passed through the guide hole and in contact with the broadhead's edge at an angle for sharpening the broadhead which is determined by the sharpening guide.

FIG. 9 is a forward end view of the handle. It shows the broadhead as seated into the handle. Note that the slot 10A which is the opening to the first cavity 10 is located at the first end of the handle and is designed to fit closely about the broadhead. When the broadhead is seated in the handle, the portion of the broadhead in contact with handle is captured by this slot, preventing the broadhead from rotating about its shaft. When fully seated, the broadhead is prevented from moving in the handle's longitudinal direction by means of the release button. The broadhead is held firmly in the handle by these two means and therefore is usable as a knife. This fixed position of the broadhead with respect to the handle also facilitates accurate sharpening of the blade.

A major problem with many prior art sharpening systems is the control of the sharpening tool. This tool is usually an abrasive rod or stone. In prior art applications, this tool is simply guided by hand across the blade edges. Often, the abrasive tools angle with respect to the blade is varied as it is moved from one area on the blade edge to the next. This result in uneven sharpening and eventually pitting which in its extreme provides an uneven blade edge with a saw-tooth-like edge.

This problem is eliminated in the present invention by means of the sharpening guide 9 which is shown in FIGS. 6, 7, 8 and 9. As can be seen in FIG. 6, the guide is a generally rectangular in shape with a horizontally positioned longitudinal axis. The guide includes first and second rectangularly shaped sharpening guide holes, 9A and 9B. The first guide hole 9A is located near the left end of the guide, while the second guide hole 9 B is located near the right end of the guide. The guide also includes two depressions 9C and 9D in the middle of the guide, with depression 9C being located over depression 9D.

This guide is inserted in the second slot 5 and is locked in place by detent pin 5A which is spring loaded by spring 7B and extends under spring pressure into depression 9D. The slot 5 extends through the handle to let a portion of the guide extend out from the handle on both sides of the handle. A second pin, not shown, extends into depression 9C. Balls may be substituted for the pins and more pins and depressions may be used if a stronger hold is desired.

Figure 8:
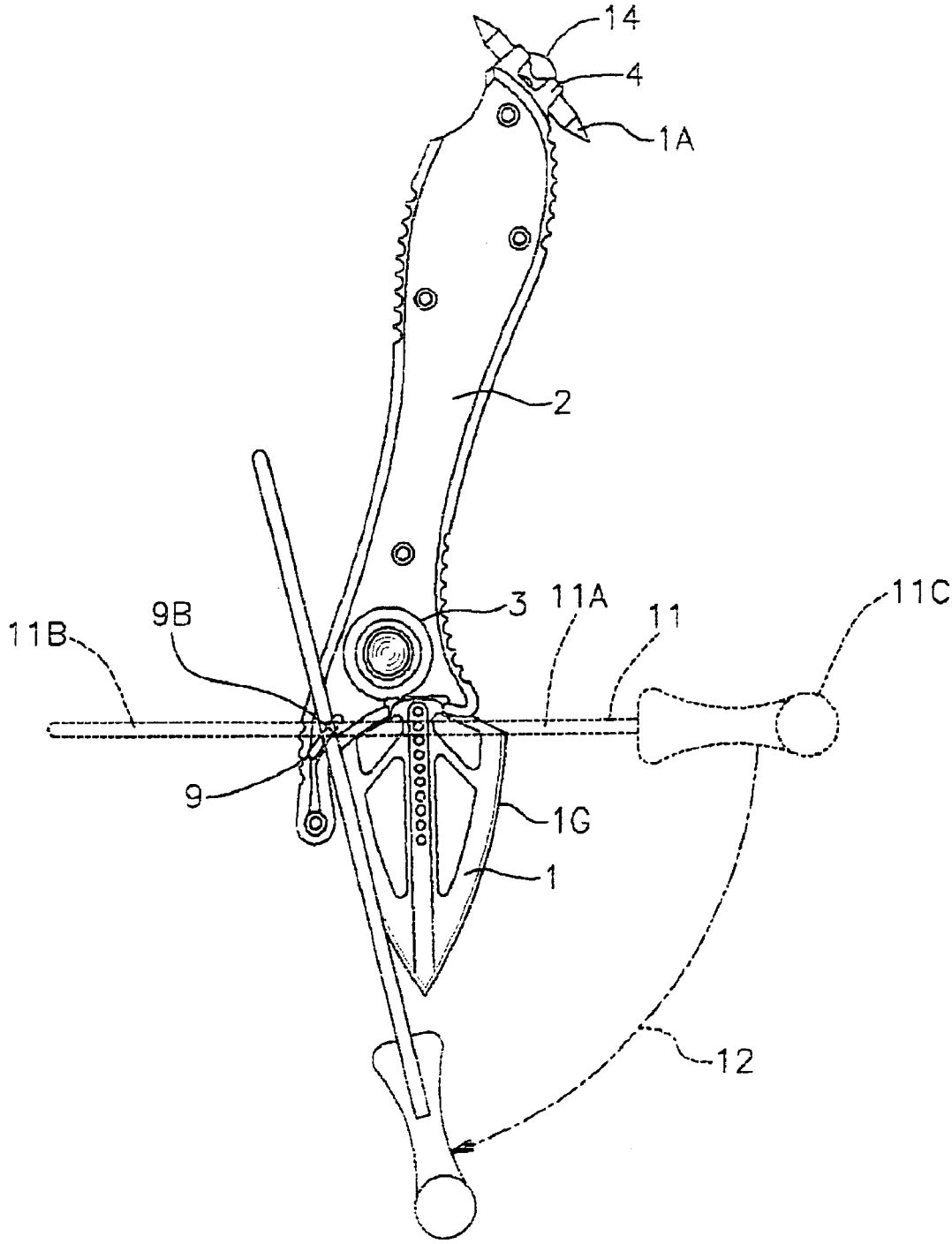
FIG. 8 shows the handle with the guide attached in its operating position and a sharpening rod placed in two positions typically used to sharpen the broadhead.

A sharpening rod, such as rod 11, is placed through hole 9B and also placed in a position to touch the broadhead blade edge 1G as shown in FIG. 8. Because the rod has one end in hole 9B, it is constrained to contact the blade edge at a specific angle which insures that the blade is sharpened properly without any gouging caused by attempting to sharpening at an improper angle between the rod and blade.

The rod 11 typically is composed of three portions, a holder 11C, located at one end of the rod, a central portion 11A with an abrasive coating and an end 11B opposite the holder end, with no coating, that is inserted in the guide holes.

The guide holes are wide enough to allow the rod to cover a complete blade edge. A second position the rod can take is illustrated in FIG. 8, where rod 11 can be rotated along arc 12A from a position of rod 11 at the side of the broadhead to a position which covers the tip of the broadhead.

All of the blade edges of the broadhead can be reached by first using both holes in the guide, to permit sharpening both sides of a broadhead blade edge. The broadhead is then released from the handle, inverted, and reinserted in the handle to place the remaining blade in a position to be sharpened by the sharpening rod.

When the sharpening has been completed, the guide may be released from slot 5 merely by applying finger pressure to the guide to force it out of the slot. The detent pins are rounded at their ends and will be forced back into the handle by the cam action of the depressions in the guide. Once released from slot 5, the guide is stored in the first cavity 6 at the second end of the handle where it is held in the cavity by magnet 10, which is located at the far end of the cavity and is secured to the handle. As can be seen in FIG. 7, a portion of the guide such as 25 percent of the guide extends outside of the handle where it can be gripped by the fingers and pulled free of the magnet when desired. The guide may be fabricated from a magnetic material or be attached to magnetic material to insure its being held in the cavity by the magnet. Alternatively, a releasable clip mechanism may be employed to hold the guide.

FIG. 1 shows the wrench 4 with projection teeth 4A and 4B located at the rear end of the handle. The opposite inside surfaces of these teeth are parallel. These teeth grip the central member 1H of the broadhead to aid in attaching to or releasing the broadhead from an arrow shaft. The way in which the wrench engages the broadhead is shown in the upper portion of FIG. 8 where a second broadhead 1A is being tightened onto an arrow shaft 14.

A preferred embodiment of the invention has been shown and described herein; however, the invention is not limited to a specific embodiment, but includes equivalent which will become obvious to those skilled in the art once exposed to the embodiment described herein. Included in such equivalent are variations in the sharpening guide to place the sharpening rod at the correct angle for wider or narrower broadhead arrow heads or other arrow heads which have blade edges in need of sharpening. Such variations in blade size can easily be accommodated by changing the size of the holes on the sharpening guide and the location of the guide with respect to the blade. The release button can be replaced by a number of mechanical equivalent including a screw clamp or a spring catch. The guide may be held in its cavity by spring clips rather than by a magnet.

The present invention does not reside solely in a single feature, but encompasses the total combination of all the features presented herein.

I claim:

1. A knife formed by the combination of an arrow head and knife handle, wherein said knife handle includes a first and a second end and a central longitudinal axis extending from said first end to said second end, said central longitudinal axis of said handle being positioned, horizontally for illustrative purposes, said handle having an outside surface that may be gripped by a hand, said outside surface having two sides with each side being generally in a different vertical plane and a top and bottom with each being in a different horizontal plane, said handle having a first slot in said first end of said handle, said first slot having a longitudinal axis, said longitudinal axis of said first slot being positioned generally vertically, said arrow head being generally flat and triangularly shaped with three tips and three narrow sides referred to as the first, second and third edges, one of said tips being designated the arrow point, said arrow point having the first and second edges meet in the arrow point and said first and second edges being sharpened to form two cutting surfaces of the arrow head, said arrow head having a central axis running through said arrow point and extending generally midway between said cutting surfaces, said arrow head having an arrow head shaft extending from the third edge of the arrow head generally outwardly of said arrow head along said central axis of said arrow head, said arrow head being positioned generally vertically, said third edge of said arrow head and the arrow head shaft fitting closely within said first slot in said knife handle to prevent rotational motion of said arrow head with respect to said handle and said handle further comprising within said first slot means for locking said arrow head shaft in said handle to form a complete knife from the combination of said handle and said arrow head.

2. A knife as claimed in claim 1 wherein said means for locking said arrow head shaft in said handle, comprising:

(a) a depression in said arrow head shaft, and (b) a bar fitting in said depression in said arrow head shaft, said bar being moveably attached to said handle and being movable from a first position within said depression in said arrow head shaft to a second position away from said arrow, head shaft to respectively lock said arrow head to said handle and to unlock said arrow head from said handle.

3. A knife as claimed in claim 2 further comprising:

(a) a button which is moveably attached to said handle, said button having a first and a second end, the first end of said button being designated the contact surface, said contact surface being exposed outside said handle's outside surface and said button being moveable from a first position where said contact surface of said button resides proximate the outside surface of the handle to a second position where the button is depressed into the handle and away from the outside surface of the handle, said button having its second end in contact with said first end of said bar, and (b) a spring having a first and a second end with the second end of said spring being in contact with said handle and the first end of said spring being in contact with said second end of said bar to urge said bar and said button from their second positions to their first positions.

4. A knife as claimed in claim 1, wherein said arrow head shaft includes screw threads on the arrow head shaft at the arrow head shafts end away from said arrow head to enable said arrow head to be attached to an arrow shaft by threading said arrow head shaft screw threads into the arrow shaft, said arrow head containing at least two adjacent and generally parallel flat surfaces to serve as gripping surface for a wrench, said handle containing on its second end two adjacent projections with inside opposing surface being flat and parallel and said opposing surfaces closely accepting said adjacent parallel flat surfaces on said arrow head to function as a wrench to tighten said arrow head into an arrow shaft to provide a complete arrow.

5. A knife as claimed in claim 1 further comprising:

(a) a second slot in said handle, said second slot being located in one of said sides of the handle and passing through said handle to the opposite side of said handle, said second slot being positioned proximate the first end of the handle and proximate the top of the handle and being oriented at an angle of between 120 and 150 degrees with respect to the central longitudinal axis of said handle, (b) a sharpening guide having a first and a second end, said guide formed of sheet material and fitting closely within said second slot, said guide extending through said slot to expose said first end of said sharpening guide on one side of said handle and said second end of said sharpening guide on the opposite side of said handle, said sharpening guide having a first guide hole through said guide proximate its first end and a second guide hole proximate its second end, said first and second holes being exposed outside of said handle when said guide is placed through said handle, said holes serving to support and guide a sharpening rod at a preferred sharpening angle with respect to the blade when sharpening, and (c) means for releasably locking said guide in said handle.

6. A knife as claimed in claim 5 wherein said means for releasably locking said sharpening guide includes a depression on one side of said guide and said handle contains a spring loaded, round headed pin moveable attached to said handle and contained within said second slot to inject said pin into said depression in said guide to hold said guide within said second slot during sharpening and to allow withdrawal of said pin to occur by way of cam action of said depression acting against said round headed pin to remove it from said depression when pressure is applied to remove said guide from said second slot.

7. A knife as claimed in claim 6 wherein said depression in said guide is located proximate the midpoint between the ends of said guide.

8. A knife as claimed in claim 6 wherein said guide contains a plurality of depressions and said handle contains a plurality of round headed pins in said second slot positioned to be placed in said depressions to releasable hold said guide in said handle.

9. A knife as claimed in claim 5 wherein said knife handle contains a cavity in its second end, said cavity accommodating said sharpening guide by accepting more than 75% of said guide within said cavity.

10. A knife as claimed in claim 9 wherein said cavity contains a magnet to releasably hold said guide within said cavity.

11. A knife as claimed in claim 1 wherein said knife contains two projections extending from its second end which have inside parallel opposing surfaces that serve as a wrench to tighten said arrow head on an arrow shaft.

* * * * *